United States Patent [19]

Stephenson et al.

[11] 4,374,449

[45] Feb. 22, 1983

[54] MINI SEAT BELT BUCKLE

[75] Inventors: Robert L. Stephenson, Utica; Robert C. Pfeiffer, Sterling Heights, both of Mich.

[73] Assignee: Allied Corporation, Morris Township, Morris County, N.J.

[21] Appl. No.: 191,058

[22] Filed: Sep. 25, 1980

[51] Int. Cl.[3] ..... A44B 11/26

[52] U.S. Cl. ..... 24/230 AL

[58] Field of Search ..... 24/230 AL, 230 R, 230 A, 24/230 AK, 230 BC

[56] References Cited

U.S. PATENT DOCUMENTS

| | | | |
|---|---|---|---|
| 3,538,558 | 11/1970 | Croft | 24/230 AL |
| 3,851,360 | 12/1974 | Minolla | 24/230 AL |
| 3,932,917 | 1/1976 | Dobelmann | 24/230 A |
| 3,935,618 | 2/1976 | Fohl | 24/230 AL |

*Primary Examiner*—Robert P. Swiatek

*Attorney, Agent, or Firm*—Roger H. Criss

[57] ABSTRACT

A mini buckle including a housing having a central opening, a push button slidably mounted in the opening and a latch member supported by the push button and movable in a direction parallel to the movement of the button.

10 Claims, 5 Drawing Figures

FIG. 1
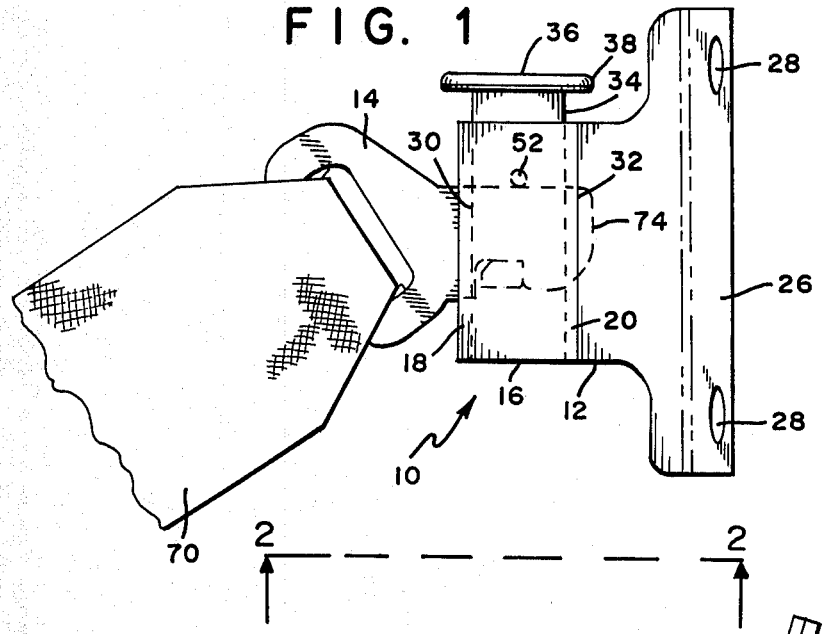
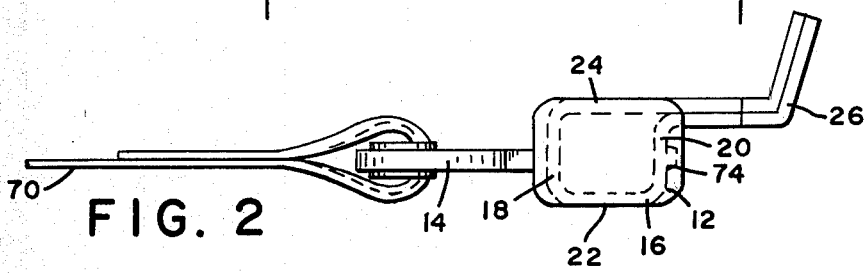
FIG. 2
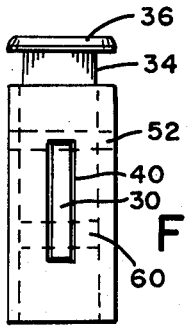
FIG. 3

MINI SEAT BELT BUCKLE

DESCRIPTION

BACKGROUND OF THE INVENTION

1. Field of the Invention

This invention relates to a small buckle, especially useful in passive seal belt systems.

2. Description of the Prior Art

Passive seat belt systems exist in which a seat belt automatically is placed about an occupant. One typical system includes an inboard retractor to which one end of the belt is attached, with the other end being attached to a tongue that mates with a buckle mounted on the door frame. The buckle and tongue combination provides a releasable interconnection for the system so that the belt can be removed in emergency situations. Existing buckles tend to be rather bulky. It would be desirable to provide a miniaturized buckle capable of performing the same function as the existing buckles.

SUMMARY OF THE INVENTION

In accordance with this invention, there is provided a seat belt buckle assembly useful for providing emergency release in a passive seat belt system, the assembly comprising:

a housing having exterior walls, a top and a bottom and an opening extending interiorly of the housing between the top and bottom;

a push button slidably mounted in a first direction within the opening and including an actuating portion extending outwardly of the opening, the button having a latch retaining means located interiorly of the opening in the housing;

latch means retained in the latch retaining means and being movable with movement of the push button in a direction parallel to the first direction;

entrance means in an exterior wall of the housing adapted to receive a tongue member; and a tongue member having a recess therein adapted for engagement with the latch means when the member is inserted in the entrance means to lock the assembly.

BRIEF DESCRIPTION OF THE DRAWINGS

FIG. 1 is a view of the seat belt buckle of this invention.

FIG. 2 is a side view of FIG. 1 taken along line 2—2.

FIG. 3 is an end view of the buckle housing.

DESCRIPTION OF THE PREFERRED EMBODIMENTS

Figure 4:
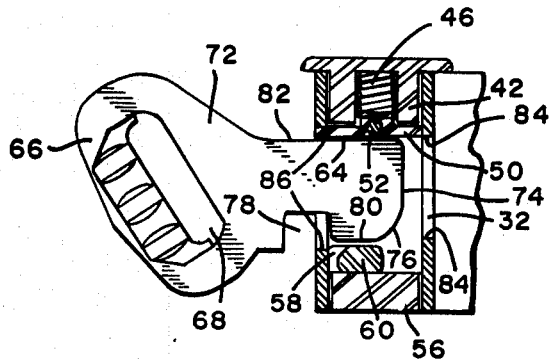
FIG. 4 is a cross-sectional view of the buckle showing the tongue during insertion.

With reference to the drawings, there is shown a mini buckle, generally indicated at 10, which includes a housing 12 and a tongue 14 adapted to be received therein. Housing 12 is formed from a single metal blank which is folded on itself to provide a generally rectangular shell 16 having end walls 18, 20 and side walls 22, 24 and an integral mounting flange 26 of double sheet thickness provided with mounting holes 28. Buckle 10 is adapted to be mounted to a door frame of a vehicle via bolts (not shown). Rectangular slot 30 is formed in wall 18 to receive tongue 14 and opposite wall 20 is provided with a corresponding slot 32. Slidably mounted within buckle shell 16 is a plastic push button 34 having a cap

36 having peripheral edges 38 which extend laterally over the edge of walls 18 and 20. Push button 34 has a slot 40 extending therethrough coextensive with slot 30 of shell 16. The central internal portion 42 of cap 36 is provided with a bore 44 for receipt of a coil spring 46, one end of which bears against the underside of cap 36 and the other end of which is supported on raised section 48 of plastic support member 50. Member 50 is fixed in shell 16 by metal pin 52 which extends through walls 22, 24. Slots 54 are formed in the sides of button 34 so that the button may slide by pin 52. The length of button 34 is chosen so that its bottom edge 56 is coextensive with the bottom of shell 16 when the button is depressed. Button 34 is provided with an internal bore 58 which extends across the width of the button and receives a metal latch 60 in press fit manner so that latch 60 moves with button 34. Latch 60 is in the form of a bar having a generally rectangular cross-section except for a forward inclined edge 62 which assists entry of tongue 14. The lower surface 64 of support 50 is smooth to provide a smooth entrance path for the tongue.

Tongue 14 is a stamped metal part and has a rearward portion 66 having a slot 68 through which seat belt webbing 70 extends. Rearward portion 66 is angled with respect to forward portion 72 of tongue 14 to provide for the proper mounting angle of webbing 70; however, mounting flange 26 may alternatively be angled for this purpose. Forward end 74 of tongue 14 is cam shaped at 76 for ease in displacing latch 60. A notch 78 is provided rearward of cam surface 76 for receiving and mating with latch 60 in order to lock the buckle.

Figure 5:
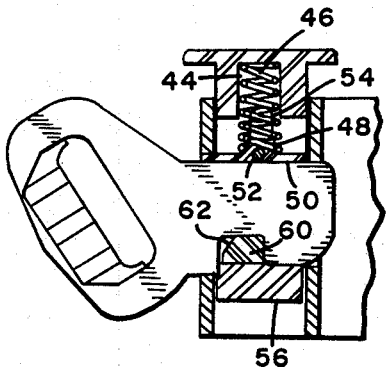
FIG. 5 is a view similar to FIG. 4 with the tongue in its locked position.

In operation, the button elements are in the position shown in FIG. 5 when the button is unlatched (with tongue 14 removed). Cap 36 extends a slight distance outward from the top of shell 16 and spring 46 is only slightly compressed. To fasten the tongue, its front edge 74 is inserted into slot 30 of shell 16. Contact of cam surface 76 (and thereafter lower surface 80) of tongue 14 with inclined edge 62 of latch 60 causes the latch and hence button 34 to move downwards, thereby compressing spring 46. The smooth surface 64 is parallel to upper edge 82 of tongue 14 and hence provides a smooth entrance path for tongue 14. When tongue 14 has been inserted far enough so that notch 78 is aligned with latch 60, spring 46 moves button 34 upwards so that latch 60 snaps into notch 78. The dimensions of tongue 14 and shell 16 are chosen so that in the locked position (FIG. 5), forward end 74 of tongue 14 extends through slot 32 in wall 20.

During crash load incidents, disengagement of tongue 14 through tensile loading is prevented as latch 60 is supported by the structural buckle shell material on both sides of slot 30. Disengagement by a camming action is prevented since the angular movement of latch 60 is limited by the edges 84 of slot 32 in wall 20 at the rearward end of the buckle and by the edges 86 of slot 30 adjacent the front end of the buckle.

To disengage the tongue, button cap 36 is manually depressed, thereby sliding latch 60 downward and out of notch 78. The rewind force of a retractor associated with webbing 70 then pulls tongue 14 out of shell 16 or the tongue may be manually pulled out of the shell.

It can be seen that latch 60 moves directly with button 34 and its release movement is parallel to the direction of the actuating motion of button 34. This permits reduction in the size of the buckle since no space for a pivoting action need be provided. Also, shell 16 may be readily stamped from sheet metal. In addition, the forward end of tongue 14 extends through shell 16 and thus assists in resisting disengagement by rotation of the tongue. Shell 16 is relatively small in size (for example, the shell measuring about 1.8×2 cm and 4 cm high and the cap about 1.8×2 cm) and provides a smooth surface of wall 22 which projects interiorly of the vehicle.

It is to be understood that variations and modifications may be made without departing from the scope hereof. It is also to be understood that the present invention is not to be limited by the specific embodiments disclosed herein but only in accordance with the appended claims when read in light of the foregoing specification.

We claim:

1. A seat belt buckle assembly useful for providing emergency release in a passive seat belt system, said buckle assembly comprising:

a housing formed from a single metal blank having exterior walls, a top and a bottom and an opening extending interiorly of said housing between said top and bottom;

a push button slidably mounted in a first direction within said opening and including an actuating portion extending outwardly of said opening, said button having a latch retaining means located interiorly of said opening in said housing:

latch means in the form of a bar retained in said latch retaining means, said latch means being movable with movement of said push button in a direction parallel to said first direction;

entrance means in an exterior wall of said housing adapted to receive a tongue member;

a tongue member having a recess therein adapted for engagement with said latch means when said tongue member is inserted in said entrance means to lock said assembly; and slot means in an exterior wall of said housing opposite to said entrance means, the forward edge of said tongue member adapted to extend through said slot means when said tongue member is fully inserted in said housing.

2. The buckle assembly of claim 1 including mounting means integral with said housing.

3. The buckle assembly of claim 1 wherein said opening in said housing extends in a generally upright direction, said first direction being parallel to said upright direction and said entrance means comprises a slot formed in a wall of said housing whereby said tongue member is adapted for insertion into said housing in a direction generally perpendicular to said upright direction.

4. The buckle assembly of claim 3 wherein said housing has a generally rectangular cross-section, wherein said slot extends in a direction generally parallel to said opening in said housing and said slot means comprises a second slot in a wall of said housing opposite said first slot and adapted to receive the forward portion of said tongue member.

5. The buckle assembly of claim 4 wherein said actuating portion of said push button comprises a cap located adjacent said top of said housing and having peripheral edges extending beyond the walls of said housing.

6. The buckle assembly of claim 5 including a spring contained within said opening of said housing and urging said push button to a position at which said latch means is in position to engage with said tongue member.

7. The buckle assembly of claim 6 wherein said latch means extends generally transverse to said first direction.

8. The buckle assembly of claim 7 including pin means extending between opposite walls of said housing and a spring support member supported by said pin means and providing a seat for said spring.

9. The buckle assembly of claim 8 wherein said recess in said tongue member comprises a notch engageable with said latch means, said latch means being positioned on said button at a location opposite to said cap, and seat belt webbing attached to said tongue member.

10. The buckle assembly of claim 6 including a recess in said push button open towards the interior of said opening, said spring being viewed in said recess.

* * * * *

UNITED STATES PATENT AND TRADEMARK OFFICE

CERTIFICATE OF CORRECTION

PATENT NO. : 4,374,449

DATED : February 22, 1983

INVENTOR(S) : Robert L. Stephenson and Robert C. Pfeiffer

It is certified that error appears in the above-identified patent and that said Letters Patent are hereby corrected as shown below:

Column 4, Line 41, "viewed" should read -- received --.

Signed and Sealed this

Tenth Day of May 1983

[SEAL]

*Attest:*

GERALD J. MOSSINGHOFF

*Attesting Officer*

*Commissioner of Patents and Trademarks*